United States Patent [19]

Appelbaum

[11] Patent Number: 4,901,543

[45] Date of Patent: Feb. 20, 1990

[54] LOCK WITH SHIELDED SHACKLE

[76] Inventor: Paul Appelbaum, Box 27006, Denver, Colo. 80227

[21] Appl. No.: 270,663

[22] Filed: Nov. 14, 1988

[51] Int. Cl.[4] ..... E05B 67/06

[52] U.S. Cl. ..... 70/53; 70/56; 70/63

[58] Field of Search ..... 70/54, 55, 56, 53, 63, 70/51, 417

[56] References Cited

U.S. PATENT DOCUMENTS

| | | | |
|---|---|---|---|
| 241,279 | 5/1881 | Barth | 70/53 |
| 1,420,578 | 6/1922 | Reichstein | 70/53 |
| 1,423,840 | 7/1922 | Durbin | 70/53 |
| 3,834,195 | 9/1974 | Winkhaus | 70/54 |
| 4,238,941 | 12/1980 | Helopoff | 70/56 |
| 4,718,259 | 1/1988 | Appelbaum | 70/63 |

*Primary Examiner*—Robert L. Wolfe

*Attorney, Agent, or Firm*—Charles C. Corbin

[57] ABSTRACT

A shackle-equipped lock with shielded shackle includes a housing enclosing a locking mechanism and a top wall with first and second bores therein. There is a shackle comprising a shaft and an inverted, generally U-shaped clasp, with the shaft lower end adapted for making locking engagement within the first bore and its upper end making a hinge joint with a first end of the clasp. The other end of the clasp is adapted for making locking engagement within the second bore, and in an unlocked condition the clasp is pivotable at the hinge about an axis which is perpendicular to the plane in which the shackle generally lies. A protective shield having a front wall, rear wall and spaced apart side walls, extends upwardly from the housing top wall, and surrounds the bores, and the front wall is spaced sufficiently from the second bore to allow the unlocked lower end of the clasp to pass when it is pivoted open.

6 Claims, 3 Drawing Sheets

LOCK WITH SHIELDED SHACKLE

BACKGROUND OF THE INVENTION

1. Field of the Invention

This invention relates greatly to padlocks and more particularly to a lock having a case with means for shielding a shackle from the grasp of a cutting tool.

2. Prior Art

Shackle-equipped key safes and lock boxes are used to hold house keys or like small items. In the real estate industry where key safes are used extensively, the shackle of the safe is typically attached around a doorknob or similar article on a building exterior.

Although the compartments of such conventional devices have fairly secure constructions, they remain vulnerable to being removed from their mount when metal-cutting shears are employed to sever the shackle. The key safe may then be moved to a place where a thief can have the time and equipment to pilfer the storage compartment.

SUMMARY OF THE INVENTION

In view of the foregoing it is an object of the present invention to provide a shackled lock which has a barrier structure that shields the shackle from the grasp of a metal severing tool.

Another object is to provide a key safe having a shielded shackle that is particularly adept at engaging doorknob stems.

Accordingly the foregoing objects are obtainable by the present invention which includes a lock housing that has spaced-apart bores in its upper wall, and a modified shackle that includes an upright shaft mountable at its lower end within a first of the bores. The shackle also has an inverted U-shaped clasp having a first, upper end that forms a hinge joint with the top of the shaft, and a second, lower end that is adapted for making releasable locking engagement within the second bore. The hinge joint provides for pivoting of the clasp about an axis perpendicular to the plane in which the shackle generally lies, such that the lower end of the clasp is swingable upwardly away from the upper wall of the lock housing. The invention also features a structure for shielding the shackle which comprises a barrier that extends upwardly for a certain distance from the upper wall of the lock housing, and which surrounds a substantial part of the lower portions of the shackle. The barrier includes spaced-apart side walls, a rear wall adjacent the shackle shaft, and a front wall that is spaced sufficiently in front of the second shackle bore to allow the lower end of the clasp to just clear it when the clasp is swung open. In a preferred embodiment a midportion of the clasp has an enlarged looping configuration and the upper portions of the barrier side walls have concave contours that cooperate with the clasp loop to enhance its ability to encircle articles.

BRIEF DESCRIPTION OF THE DRAWINGS

FIG. 5 is an enlarged exploded view illustrating the padlock assembly employed in the preferred embodiment;

FIG. 6 is a sectional view taken along a plane through the line 6—6 of FIG. 5; and FIG. 7 is a sectional view taken along a plane through the line 7—7 of FIG. 5.

DETAILED DESCRIPTION OF THE INVENTION

Figure 1:
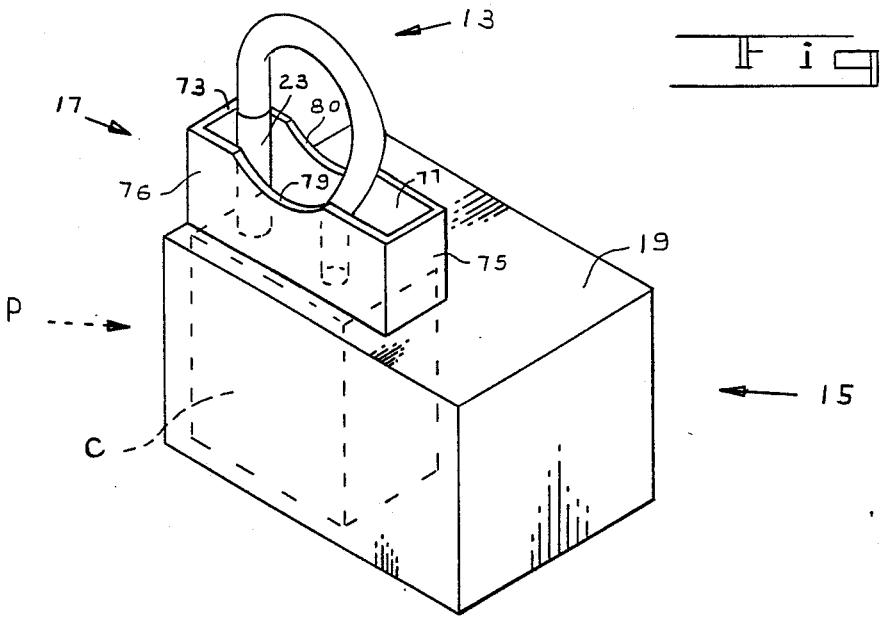
FIG. 1 is a perspective view showing a shackle guard-equipped key safe according to the present invention.

As FIG. 1 illustrates the main components of the preferred embodiment of the invention include a padlock P having a conventional case portion C and a modified shackle unit 13, a key safe 15 in which case C is affixed, and a shackle guard 17 affixed to the upper wall 19 of the key safe 15.

The key safe 15, excluding modified shackle 13 and the guard structure 17, has a construction similar to that of the key safe shown in U.S. Pat. No. 4,718,259. It will become apparent to those skilled in the art, however, that the present invention is incorporatable in any type of a case or housing construction that will mount a shackle locking mechanism and which provides an upper, shackle-receiving wall upon which a shackle guard may be constructed.

FIG. 5 illustrates that the main components of the padlock P include chase C, shackle shaft 21, tubular sleeve 23 and looping clasp 25. The case C is of a known popular design that is fabricated of a plurality of laminates 27, held together by rivets 29. The top laminate 31 has a first, enlarged bore 33, and a second bore 35. The lower side of bore 33 has a counter-bored portion 37, as best shown in FIG. 7. The lower end 39 of shaft 21 is received within case C via bore 41 in the manner of the longer leg of a conventional U-shaped shackle and padlock, and is vertically shiftable from a raised unlocked position to which it is urged by spring means (not shown) to a locked position to which it is lowered. Shaft 21 is rotatable about its longitudinal axis.

In fabricating this component the invention of the sleeve 23 is mounted over shaft 21 and then the uppermost laminate 31 is assembled thereover with the sleeve flange 43 being received within the counter-bore portion 37. The rivets 29 are then secured. The top of shaft 21 is slotted at 45 and has pin receiving hole 47 therethrough.

Figure 2:
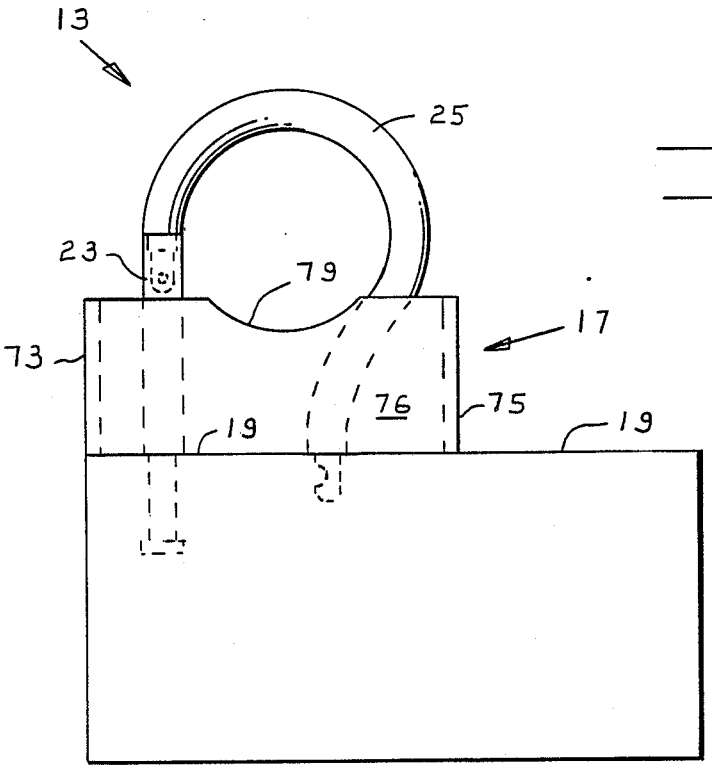
FIG. 2 is a side elevational view of the device of FIG. 1, with shackle locked.

Clasp 25 has upper end 49 with a shoulder 50 and a foot 51 that carries bore 53. Clasp lower leg 55 terminates in a locking tip 57 which is adapted to be received by laminate bore 35 and case bore 59 and to make locking engagement within case C. The clasp midportion 60 follows a looping configuration as best shown in FIG. 2. This portion may also have a rectangular or other shape designed to encircle structures. It can be readily appreciated that the span of midportion 60 is significantly wider than the spacing between the bore 35 and 33, which interbore spacing reflects a limiting factor of conventional shackles.

Clasp upper end 49 is hingedly attached to the top of shaft 21 when foot 51 fits slot 45, and a locking pin 63 is secured through bores 47 and 53. The hinge joint thusly formed is designated by the reference numeral 65, seen in FIG. 3. The lower surface 67 of foot 51 will engage the bottom of slot 45 to limit the inward pivoting of clasp 25.

Figure 4:
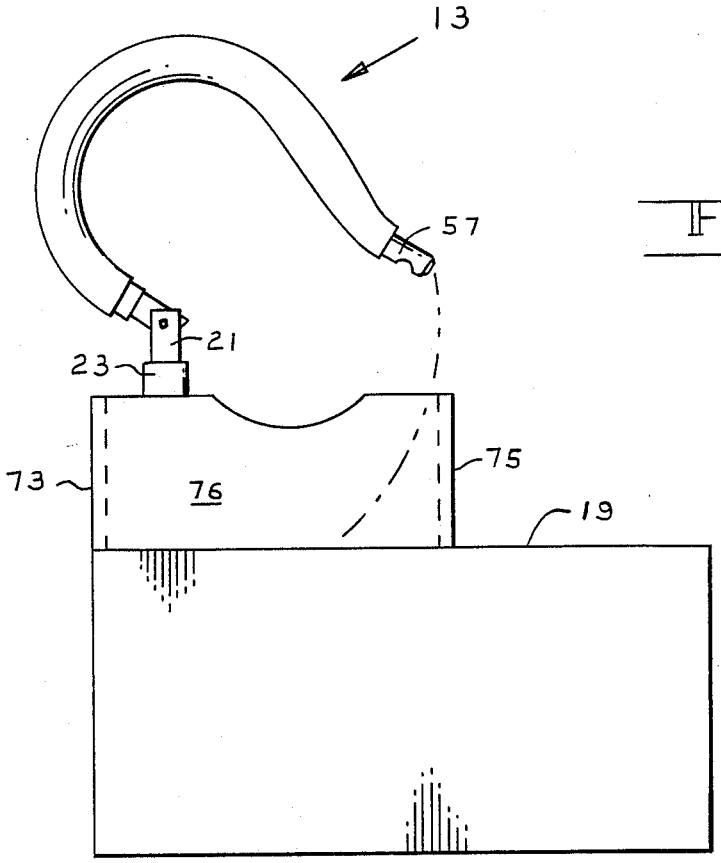
FIG. 4 is a similar view to FIG. 3, but showing the shackle swung open.

It is to be appreciated that when case C is unlocked and shaft 21 is urged to its upward, unlocked position, the hinge joint 65 is above the confines of sleeve 23, and clasp 25 is free to pivot openly as illustrated in FIG. 4. In this configuration the clasp 25 is also rotatable about the rotational axis of shaft 21.

The aforedescribed padlock and shackle assembly is mounted to key safe 15 with case C affixed therein by welding or other suitable means. The top of case C lies adjacent the inside of key safe top wall 19 which has been provided with a hole 69 for passing shaft 21 and a hole 70 which is aligned above padlock bore 35.

Figure 3:
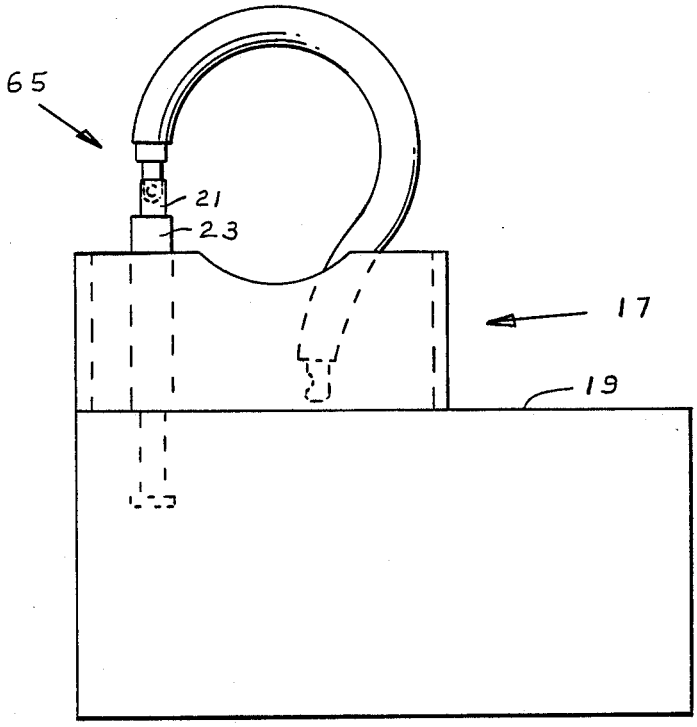
FIG. 3 is a similar view to FIG. 2 but with the shackle unlocked.

In the unlocked position shown in FIG. 3 the clasp 25 has been fully rotated inwardly with the aforedescribed limiting structures of hinge 65 holding the locking tip 57 such that it is movable through an arc which can bring it in alignment above 35.

FIGS. 1 and 2 show the shackle guard 17 to include a rear wall 73, front wall 75, and first and second spaced-apart side walls 76 and 77. In the views hereshown shackle 13 is locked, with clasp end 57 and the lower end of shaft 21 in locking engagement within the case bores. The hinge joint 65 is fully protectively enveloped by the sleeve 23.

The side walls 76 and 77 are preferably spaced apart by a distance which brings them in fairly close proximity to the clasp 25 and sleeve 23, for maximum protection. The rear wall 73 is also preferably close to sleeve 23. FIG. 2 shows that the walls of the shackle guard extend upwardly for a substantial distance above top wall 19, relative to the upward extension of shackle 13, thereby shielding a substantial part of sleeve 23 and clasp 25. FIG. 1 and FIG. 2 also show that the upper edges of side walls 76 and 77 have arcuate depressions at 79 and 80. These depressions cooperate with the generally circular contour of the inner side of clasp 25, so as to enhance the ability of shackle 13 to embrace the circular stems of doorknobs and the like.

When shackle 13 is unlocked from case C, the clasp 25 may be pivoted by virtue of hinge joint 65, as illustrated in FIG. 4. Thus the front wall 75 of the shackle guard 17 preferably has a height which spaces it just beyond the swinging path taken by the lower end 75 of clasp 25 when it is pivoted for opening and closing.

Various changes, modifications and other uses may be made of the invention which is limited only by the following claims.

What is claimed is:

1. Shackle-equipped lock with shielded shackle, including:

(a) a housing enclosing a locking mechanism and having a top wall with first and second bores therein;

(b) shackle, including a shaft having a lower end adapted for making locking engagement within said first bore and an upper end adapted for forming a hinge joint, and said clasp having an upper end, lower leg and a looping midportion, said lower leg adapted for making locking engagement within said second bore, and said upper clasp end making a hinge joint with the upper end of said shaft for rotation of said clasp about an axis perpendicular to the general plane in which said shackle lies, and said shackle having a locked configuration in which said shaft and clasp are locked within said first and second bores, and an unlocked configuration in which said clasp is free to rotate about said axis; and (c) protective shield surrounding said first and second bores and having a front wall, rear wall and spaced apart side walls, said shield extending upwardly from said housing top wall for a substantial distance relative to the upward extent of said shackle when in its locked configuration, and said front wall spaced from said second bore sufficiently to allow the unlocked lower leg of said clasp to pass when said clasp is rotated.

2. Device as defined in claim 1 wherein each upper edge of the side walls of said shield has an arcuate contour therein.

3. Device as defined in claim 1 wherein said shaft is rotatably mounted in said first bore.

4. Device as defined in claim 1 wherein said housing is a key safe having a lockable storage compartment.

5. Device as defined in claim 1 wherein said rear and side walls of said shield lie in close proximity to said shaft, and to said clasp when said clasp is locked.

6. Device as defined in claim 4 wherein said locking mechanism is a padlock case mounted within said housing.

* * * * *